US012702189B2

(12) United States Patent
Munger et al.

(10) Patent No.: US 12,702,189 B2
(45) Date of Patent: Aug. 11, 2026

(54) RAPID-ENTRY FOOTWEAR HAVING A MULTI-ACTION COUNTER

(71) Applicant: FAST IP, LLC, Lindon, UT (US)

(72) Inventors: Seth Munger, Springville, UT (US); Craig Cheney, Lindon, UT (US)

(73) Assignee: FAST IP, LLC, Lindon, UT (US)

( * ) Notice: Subject to any disclaimer, the term of this patent is extended or adjusted under 35 U.S.C. 154(b) by 0 days.

(21) Appl. No.: 18/615,145

(22) Filed: Mar. 25, 2024

(65) Prior Publication Data

US 2024/0225176 A1 Jul. 11, 2024

Related U.S. Application Data

(63) Continuation of application No. PCT/US2022/044623, filed on Sep. 23, 2022.

(60) Provisional application No. 63/247,689, filed on Sep. 23, 2021.

(51) Int. Cl.

| | |
|---|---|
| ***A43B 11/00*** | (2006.01) |
| ***A43B 3/24*** | (2006.01) |
| ***A43B 23/08*** | (2006.01) |

(52) U.S. Cl.

CPC ..... *A43B 11/00* (2013.01); *A43B 3/248* (2013.01); *A43B 23/08* (2013.01)

(58) Field of Classification Search

CPC ..... A43B 11/00; A43B 3/248; A43B 23/08; A43B 23/088

USPC ..... 36/138

See application file for complete search history.

(56) References Cited

U.S. PATENT DOCUMENTS

| | | | |
|---|---|---|---|
| 112,439 | A | 3/1871 | Francis |
| 287,312 | A | 10/1883 | Packard |
| 736,156 | A | 8/1903 | Roberts |
| 808,948 | A | 1/1906 | Roberts |
| 827,330 | A | 7/1906 | Tillson |
| 863,549 | A | 8/1907 | Metz |
| 881,153 | A | 3/1908 | Rickert |
| 921,461 | A | 5/1909 | Rickert |
| 923,860 | A | 6/1909 | Kroell |
| 1,081,678 | A | 12/1913 | Meyer |
| 1,110,624 | A | 9/1914 | Guiffre |
| 1,116,462 | A | 11/1914 | Moran |
| 1,266,620 | A | 5/1918 | Peabody |
| 1,464,342 | A | 8/1923 | Rothacher |
| 1,494,236 | A | 5/1924 | Greathouse |

(Continued)

FOREIGN PATENT DOCUMENTS

| | | | |
|---|---|---|---|
| CN | 2438353 | Y | 7/2001 |
| CN | 1403041 | A | 3/2003 |

(Continued)

OTHER PUBLICATIONS https://us.ecco.com/ecco-biom-fjuel-mens-outdoor-shoe-837594.html?dwvar_837594_color=00001 submitted herewith as of Jun. 1, 2016.

(Continued)

*Primary Examiner* — Marie D Bays

(57) ABSTRACT

A rapid-entry shoe with a multi-action counter having a first component that can cause a first transformation of an upper of the rapid-entry shoe and a second component that can cause a second transformation of the upper. Hands-free donning of the rapid-entry shoe is facilitated once both the first transformation and the second transformation are complete.

14 Claims, 5 Drawing Sheets

(56) References Cited

U.S. PATENT DOCUMENTS 1,686,175 A 10/1928 Read
1,926,818 A 9/1933 Rateliff
1,945,420 A 1/1934 Charles
2,024,766 A 12/1935 Ingwer
2,069,752 A 2/1937 Dorr
2,083,390 A 6/1937 Murena
2,118,019 A 5/1938 Benjafield
2,188,603 A 1/1940 Hamalainen
2,266,732 A 12/1941 Babinchak
2,297,594 A 9/1942 Weinstat
2,368,514 A 1/1945 Baehr
2,450,250 A 9/1948 Napton
2,452,502 A 10/1948 Tarbox
2,693,039 A 11/1954 Balut
2,736,110 A 2/1956 Hardimon
2,763,071 A 9/1956 Hastings
2,829,448 A 4/1958 Minera
2,920,402 A 1/1960 Minera
2,945,309 A 7/1960 Shapiro
3,000,116 A 9/1961 Ally
3,014,288 A 12/1961 Evans et al.
3,040,454 A 6/1962 Topper et al.
3,097,438 A 7/1963 Evans
3,146,535 A 9/1964 Owings
3,192,651 A 7/1965 Smith
3,373,512 A 3/1968 Jacobson
3,643,350 A 2/1972 Paoletta et al.
3,798,802 A 3/1974 Saunders
4,489,509 A 12/1984 Libit
4,590,690 A 5/1986 Pfander
4,596,080 A 6/1986 Benoit et al.
4,805,321 A 2/1989 Tonkel
4,811,502 A 3/1989 Barret
4,924,605 A 5/1990 Spademan
4,972,613 A 11/1990 Loveder
4,979,319 A 12/1990 Hayes
5,054,216 A 10/1991 Lin
5,090,140 A 2/1992 Sessa
5,127,170 A 7/1992 Messina
5,174,050 A 12/1992 Gabrielli
5,181,331 A 1/1993 Berger
5,184,410 A 2/1993 Hamilton
5,257,470 A 11/1993 Auger et al.
5,259,126 A 11/1993 Rosen
5,265,353 A 11/1993 Marega et al.
5,282,327 A 2/1994 Ogle
5,311,678 A 5/1994 Spademan
5,319,869 A 6/1994 Mcdonald et al.
5,341,583 A 8/1994 Hallenbeck
5,351,583 A 10/1994 Szymber et al.
5,371,957 A 12/1994 Gaudio
5,430,961 A 7/1995 Faulconer et al.
5,467,537 A 11/1995 Aveni et al.
5,481,814 A 1/1996 Spencer
5,784,808 A 7/1998 Hockerson
5,806,208 A 9/1998 French
5,842,292 A 12/1998 Siesel
5,846,063 A 12/1998 Lakic
5,946,825 A 9/1999 Koh et al.
5,983,530 A 11/1999 Chou
5,997,027 A 12/1999 Jungkind
6,000,148 A * 12/1999 Cretinon ..... A43B 7/14 36/88
6,014,823 A 1/2000 Lakic
6,125,555 A 10/2000 Schenkel
6,128,837 A 10/2000 Huang
6,170,173 B1 1/2001 Caston
6,189,239 B1 2/2001 Gasparovic et al.
6,290,559 B1 9/2001 Scott
6,321,466 B1 11/2001 Bordin et al.
6,360,454 B1 3/2002 Dachgruber et al.
6,367,171 B1 4/2002 Burt
6,378,230 B1 4/2002 Rotem et al.
6,470,537 B1 10/2002 Schallenkamp
6,643,954 B2 11/2003 Voswinkel
6,671,980 B1 1/2004 Liu
6,684,533 B1 2/2004 Su
6,839,985 B2 1/2005 Bettiol
6,877,252 B2 4/2005 Wilkinson
6,922,917 B2 8/2005 Kerns et al.
6,925,732 B1 8/2005 Clarke
6,988,328 B2 1/2006 Rosen et al.
7,059,068 B2 6/2006 Magallanes et al.
7,103,994 B2 9/2006 Johnson
7,178,270 B2 2/2007 Hurd et al.
7,225,563 B2 6/2007 Chen et al.
7,439,837 B2 10/2008 Mcdonald
D583,956 S 12/2008 Chang et al.
7,661,205 B2 2/2010 Johnson
7,685,747 B1 3/2010 Gasparovic et al.
7,757,414 B2 7/2010 Tonkel
7,774,884 B2 8/2010 Greene et al.
7,793,438 B1 9/2010 Busse et al.
7,823,299 B1 11/2010 Brigham
7,886,462 B2 2/2011 Shepherd et al.
D648,512 S 11/2011 Schlageter et al.
8,065,818 B2 11/2011 Greene et al.
8,087,188 B2 1/2012 Labbe
8,156,664 B2 4/2012 Shepherd et al.
8,225,535 B2 7/2012 Dillenbeck
8,302,329 B2 11/2012 Hurd et al.
8,333,021 B2 12/2012 Johnson
8,499,474 B2 8/2013 Kaufman
8,745,901 B2 6/2014 Toraya
9,119,441 B2 9/2015 Frappier
9,254,014 B2 2/2016 Weitzman
9,314,067 B2 4/2016 Bock
9,351,532 B2 5/2016 Mokos
9,456,652 B2 10/2016 Davis et al.
9,615,624 B2 4/2017 Kilgore et al.
9,629,416 B2 4/2017 Rackiewicz et al.
9,635,905 B2 5/2017 Dekovic
9,717,304 B2 8/2017 Bernhard et al.
9,877,542 B2 1/2018 Pratt
9,999,278 B2 6/2018 Feinstein
10,271,616 B2 4/2019 Labbe
10,327,515 B2 6/2019 Peyton et al.
D854,303 S 7/2019 Flanagan et al.
10,455,898 B1 10/2019 Orand et al.
10,499,707 B2 12/2019 Hobson et al.
10,506,842 B2 12/2019 Pratt et al.
10,537,154 B2 1/2020 Smith et al.
10,555,578 B2 2/2020 Pratt
10,568,382 B2 2/2020 Hatfield et al.
10,568,385 B2 2/2020 Beers et al.
10,602,802 B2 3/2020 Hopkins et al.
10,609,981 B1 4/2020 Phinney
10,617,173 B2 4/2020 Twist
10,617,174 B1 4/2020 Hopkins et al.
10,638,810 B1 * 5/2020 Cheney ..... A43B 3/248
10,653,209 B2 5/2020 Pratt et al.
10,660,401 B1 5/2020 Pratt et al.
10,743,616 B2 8/2020 Beers et al.
10,791,796 B1 10/2020 Baker
10,813,405 B2 10/2020 Pratt
10,897,956 B2 1/2021 Hopkins
10,905,192 B1 * 2/2021 Cheney ..... A43B 3/246
10,912,348 B2 2/2021 Owings et al.
10,973,278 B2 4/2021 Raia
11,000,091 B1 5/2021 Kyle
11,140,941 B2 10/2021 Xanthos et al.
11,154,113 B2 10/2021 Hatfield et al.
11,172,727 B2 11/2021 Hatfield et al.
11,191,321 B2 * 12/2021 Kilgore ..... A43B 3/0063
11,213,098 B2 1/2022 Beers et al.
11,234,482 B2 2/2022 Roser
D948,190 S 4/2022 Jury
D948,191 S 4/2022 Holmes
D949,540 S 4/2022 Jury
D949,544 S 4/2022 Witherow
11,344,077 B2 5/2022 Hopkins et al.
D955,732 S 6/2022 Kelley
11,464,287 B2 * 10/2022 Kilgore ..... A43B 23/088
11,617,410 B1 4/2023 Kim

(56) References Cited

U.S. PATENT DOCUMENTS 11,622,601 B2 4/2023 Piacentini
11,633,005 B2 4/2023 Pratt et al.
11,633,006 B2 4/2023 Pratt et al.
11,633,016 B2 4/2023 Orand et al.
11,659,886 B2 5/2023 Cheney et al.
11,700,916 B2 * 7/2023 Kilgore ..... A43B 11/00 36/45
11,707,113 B2 7/2023 Hopkins et al.
D993,601 S 8/2023 Wang et al.
11,737,511 B2 8/2023 Cheney et al.
11,744,319 B2 9/2023 Farina
11,839,258 B2 12/2023 Cheney et al.
11,844,394 B2 12/2023 Cheney
11,864,620 B2 1/2024 Cheney et al.
2001/0001350 A1 5/2001 Aguerre
2002/0053147 A1 5/2002 Borsoi et al.
2002/0066213 A1 6/2002 Wells
2002/0095823 A1 7/2002 Laio et al.
2002/0144434 A1 10/2002 Farys et al.
2002/0174568 A1 11/2002 Neiley
2003/0106244 A1 6/2003 Miller et al.
2004/0003517 A1 1/2004 Marvin et al.
2004/0088890 A1 5/2004 Matis et al.
2004/0111921 A1 6/2004 Lenormand
2005/0022428 A1 2/2005 Anderson
2005/0034328 A1 2/2005 Geer
2005/0039348 A1 2/2005 Raluy et al.
2005/0076540 A1 4/2005 Su
2005/0198867 A1 9/2005 Labbe
2005/0241189 A1 11/2005 Elkington et al.
2006/0156587 A1 7/2006 Pawlus et al.
2007/0074425 A1 4/2007 Leong
2007/0209234 A1 9/2007 Chou
2007/0256329 A1 11/2007 Antonelli et al.
2007/0271822 A1 11/2007 Meschter
2007/0277394 A1 12/2007 Hansen et al.
2008/0092406 A1 4/2008 Ludemann
2008/0168683 A1 7/2008 Keating
2008/0189984 A1 8/2008 Januszewski et al.
2008/0276492 A1 11/2008 Burnett
2008/0307673 A1 12/2008 Johnson
2008/0313929 A1 12/2008 Hoyt
2009/0090026 A1 4/2009 Mosher
2009/0223084 A1 9/2009 Kaufman
2010/0037483 A1 2/2010 Meschter et al.
2010/0095494 A1 4/2010 Martin
2010/0095554 A1 4/2010 Gillespie
2010/0251572 A1 10/2010 Baudouin et al.
2011/0016751 A1 1/2011 Somerville
2011/0185592 A1 8/2011 Nishiwaki et al.
2011/0214313 A1 9/2011 James et al.
2011/0239489 A1 10/2011 Iuchi et al.
2011/0277350 A1 11/2011 Huynh
2012/0055044 A1 3/2012 Dojan et al.
2012/0060395 A1 3/2012 Blevens et al.
2012/0151799 A1 6/2012 Weinreb
2012/0167413 A1 7/2012 Marvin et al.
2012/0180338 A1 7/2012 Lin
2012/0186106 A1 7/2012 Recchi et al.
2012/0216429 A1 8/2012 Bastida et al.
2012/0317839 A1 * 12/2012 Pratt ..... A43B 21/42 36/105
2013/0160328 A1 6/2013 Hatfield et al.
2013/0185959 A1 7/2013 Coleman
2013/0219747 A1 8/2013 Lederer
2013/0312285 A1 11/2013 Sharma et al.
2014/0013624 A1 1/2014 Stockbridge et al.
2014/0090274 A1 4/2014 Arquilla
2014/0101975 A1 4/2014 Ueda
2014/0123516 A1 5/2014 Cressman et al.
2014/0173932 A1 6/2014 Bell
2014/0189964 A1 7/2014 Wen et al.
2014/0202044 A1 * 7/2014 Adami ..... A43B 7/19 36/34 R
2014/0259781 A1 9/2014 Sakai
2014/0298687 A1 10/2014 Flinterman et al.
2014/0305005 A1 * 10/2014 Yeh ..... A43B 7/144 36/69
2014/0373396 A1 12/2014 Chang
2015/0013184 A1 1/2015 Beers
2015/0013189 A1 1/2015 Hanak et al.
2015/0020416 A1 1/2015 Wiens
2015/0047222 A1 2/2015 Rushbrook
2015/0047223 A1 2/2015 Flinterman et al.
2015/0165338 A1 6/2015 Choe
2015/0216252 A1 8/2015 Wiens
2015/0305432 A1 10/2015 Wiens
2015/0305442 A1 10/2015 Ravindran
2016/0007674 A1 1/2016 Labonte et al.
2016/0128424 A1 5/2016 Connell et al.
2016/0262492 A1 9/2016 Fujita et al.
2016/0302530 A1 10/2016 Smith et al.
2016/0374427 A1 12/2016 Zahabian
2017/0013915 A1 1/2017 Caston, Jr.
2017/0035148 A1 2/2017 Marvin et al.
2017/0055630 A1 3/2017 Marshall
2017/0127755 A1 5/2017 Bunnell et al.
2017/0265562 A1 9/2017 Mullen
2017/0303632 A1 10/2017 Pratt et al.
2017/0360141 A1 12/2017 Azoulay et al.
2017/0360143 A1 12/2017 Pratt et al.
2018/0110292 A1 * 4/2018 Beers ..... A43B 21/28
2018/0199659 A1 7/2018 Lintaman
2018/0235314 A1 8/2018 Farage
2018/0255865 A1 9/2018 Hsu
2018/0263332 A1 9/2018 Bruno
2018/0289109 A1 * 10/2018 Beers ..... A43B 11/00
2018/0295942 A1 10/2018 Drake
2018/0338572 A1 11/2018 Cross et al.
2018/0343968 A1 12/2018 James et al.
2019/0053571 A1 2/2019 Bjornson et al.
2019/0116916 A1 4/2019 Burch
2019/0281920 A1 9/2019 Ito et al.
2019/0289960 A1 9/2019 Loveder
2019/0297999 A1 * 10/2019 Nakaya ..... A43B 23/08
2019/0307208 A1 10/2019 Corcoran-Tadd et al.
2019/0365029 A1 12/2019 Cross et al.
2019/0366667 A1 12/2019 Cross et al.
2020/0015544 A1 1/2020 Pratt
2020/0046066 A1 2/2020 Difrancisco
2020/0068991 A1 3/2020 Steere et al.
2020/0085136 A1 3/2020 Pratt et al.
2020/0113274 A1 4/2020 Butler
2020/0187590 A1 6/2020 Hopkins et al.
2020/0196787 A1 6/2020 Dament et al.
2020/0205511 A1 * 7/2020 Hopkins ..... A43B 11/02
2020/0205512 A1 7/2020 Blanche et al.
2020/0205516 A1 * 7/2020 Kilgore ..... A43B 21/24
2020/0205517 A1 7/2020 Happen
2020/0205518 A1 * 7/2020 Hopkins ..... A43B 23/17
2020/0205520 A1 7/2020 Kilgore
2020/0245797 A1 8/2020 Kim
2020/0305552 A1 10/2020 Cheney et al.
2020/0323308 A1 10/2020 Dubuisson
2020/0375319 A1 12/2020 Yang
2020/0383424 A1 12/2020 Hughes
2021/0068493 A1 3/2021 Pratt et al.
2021/0068494 A1 3/2021 Zahabian
2021/0068498 A1 3/2021 Cheney et al.
2021/0106094 A1 4/2021 Cheney
2021/0112911 A1 4/2021 Pratt et al.
2021/0112914 A1 * 4/2021 Cheney ..... A43B 11/00
2021/0112916 A1 4/2021 Schulten
2021/0127788 A1 5/2021 Li
2021/0145114 A1 5/2021 Kyle
2021/0169177 A1 6/2021 Yang
2021/0186146 A1 6/2021 Erwin
2021/0204642 A1 7/2021 Kyle
2021/0204643 A1 7/2021 Kyle
2021/0204644 A1 7/2021 Kyle
2021/0204645 A1 7/2021 Pratt
2021/0227923 A1 7/2021 Love et al.
2021/0235811 A1 8/2021 Oh
2021/0282495 A1 9/2021 Davis et al.

(56) References Cited

U.S. PATENT DOCUMENTS

| | | | | |
|---|---|---|---|---|
| 2021/0321718 | A1 | 10/2021 | Chang | |
| 2021/0330033 | A1 | 10/2021 | Pratt et al. | |
| 2021/0345727 | A1 | 11/2021 | Raia | |
| 2021/0378356 | A1* | 12/2021 | Cheney | A43B 11/00 |
| 2022/0104582 | A1 | 4/2022 | Christensen et al. | |
| 2022/0132976 | A1 | 5/2022 | Bentz | |
| 2022/0142291 | A1 | 5/2022 | Cheney et al. | |
| 2022/0240625 | A1 | 8/2022 | Shin | |
| 2022/0287406 | A1 | 9/2022 | Cheney et al. | |
| 2022/0361627 | A1 | 11/2022 | Cheney et al. | |
| 2022/0369758 | A1 | 11/2022 | Pratt | |
| 2022/0378144 | A1 | 12/2022 | Pratt et al. | |
| 2022/0400810 | A1 | 12/2022 | Cheney et al. | |
| 2023/0030016 | A1 | 2/2023 | Pratt et al. | |
| 2023/0033366 | A1* | 2/2023 | Farina | A43B 21/30 |
| 2023/0035573 | A1 | 2/2023 | Bar | |
| 2023/0052916 | A1 | 2/2023 | Bar | |
| 2023/0077572 | A1 | 3/2023 | Dean et al. | |
| 2023/0081272 | A1 | 3/2023 | Pratt | |
| 2023/0084256 | A1 | 3/2023 | Brilliant | |
| 2023/0107425 | A1* | 4/2023 | Andreasen | A43B 21/28 36/138 |
| 2023/0218033 | A1 | 7/2023 | Cheney | |
| 2023/0225450 | A1 | 7/2023 | Cheney et al. | |
| 2023/0263270 | A1 | 8/2023 | Jones | |
| 2023/0276897 | A1 | 9/2023 | Cheney et al. | |
| 2023/0284737 | A1 | 9/2023 | Bar | |
| 2023/0363489 | A1 | 11/2023 | Kyle | |

FOREIGN PATENT DOCUMENTS

| | | | |
|---|---|---|---|
| CN | 201005111 | Y | 1/2008 |
| CN | 101991227 | A | 3/2011 |
| CN | 107467775 | A | 12/2017 |
| CN | 108577022 | A | 9/2018 |
| DE | 19534249 | A1 | 3/1997 |
| DE | 19611797 | A1 | 10/1997 |
| DE | 29809404 | U1 | 8/1998 |
| DE | 10247163 | A1 | 4/2004 |
| DE | 102004005288 | A1 | 8/2005 |
| EP | 0526892 | A2 | 2/1993 |
| EP | 1059044 | A1 | 12/2000 |
| EP | 1952715 | A1 | 8/2008 |
| EP | 3266327 | A1 | 1/2018 |
| FR | 3066679 | A1 | 11/2018 |
| GB | 2517399 | A | 2/2015 |
| JP | 01-081910 | U | 6/1989 |
| JP | 11-127907 | A | 5/1999 |
| JP | 2001-149394 | A | 6/2001 |
| JP | 2006-055571 | A | 3/2006 |
| JP | 2010-104416 | A | 5/2010 |
| JP | 2013-510685 | A | 3/2013 |
| JP | 2014-161721 | A | 9/2014 |
| KR | 10-2005-0095542 | A | 9/2005 |
| KR | 10-2009-0093548 | A | 9/2009 |
| KR | 10-2009-0130804 | A | 12/2009 |
| KR | 10-0936510 | B1 | 1/2010 |
| NL | 2000762 | C1 | 1/2009 |
| WO | 2007/048678 | A1 | 5/2007 |
| WO | 2007/080205 | A1 | 7/2007 |
| WO | 2009/089572 | A1 | 7/2009 |
| WO | 2009/154350 | A1 | 12/2009 |
| WO | 2017/004135 | A2 | 1/2017 |
| WO | 2018/230961 | A1 | 12/2018 |
| WO | 2019/215359 | A1 | 11/2019 |
| WO | 2020/006490 | A1 | 1/2020 |
| WO | 2020/176653 | A1 | 9/2020 |
| WO | 2021/162569 | A1 | 8/2021 |
| WO | 2022/204444 | A1 | 9/2022 |
| WO | 2022/221339 | A1 | 10/2022 |
| WO | 2023/049414 | A1 | 3/2023 |
| WO | 2023/064568 | A1 | 4/2023 |

OTHER PUBLICATIONS https://www.teva.com/kids-sandals/hurricane-drift/ 1102483C.html submitted herewith as of Jun. 13, 2019.

International Search Report and Written Opinion received for PCT Patent Application No. PCT/US22/44623, mailed or Jan. 3, 2023, 7 pages.

Sneider, "Kizik Handsfree New York Shoe Review," https://the-gadgeteer.com/2018/06/27 /kizik-handsfree-new-york-show-review/ (2018).

U.S. Appl. No. 62/186,148, filed Jun. 29, 2015, Zahabian.

U.S. Provisional Application Filed on Date Jun. 29, 2015 by Zahabian., U.S. Appl. No. 62/186,148.

* cited by examiner

RAPID-ENTRY FOOTWEAR HAVING A MULTI-ACTION COUNTER

CROSS-REFERENCE TO RELATED APPLICATION

This application is a continuation of, claims priority to and the benefit of PCT Serial No. PCT/US22/44623 filed Sep. 23, 2022 and entitled "RAPID-ENTRY FOOTWEAR HAVING A MULTI-ACTION COUNTER." PCT Serial No. PCT/US22/44623 claims the benefit of U.S. Provisional Patent Application No. 63/247,689, filed Sep. 23, 2021 and entitled "RAPID-ENTRY FOOTWEAR HAVING A MULTI-ACTION COUNTER." All of the aforementioned applications are incorporated herein by reference in their entireties.

FIELD

The present disclosure relates to footwear, and more particularly to rapid-entry footwear having a multi-action counter.

BACKGROUND

Whether due to inconvenience or inability, donning and doffing of shoes, including tying or otherwise securing the same, may be undesirable and/or present difficulties to some individuals. The present disclosure addresses this need.

SUMMARY

A rapid-entry shoe in accordance with example embodiments of the present disclosure comprises a multi-action counter, the multi-action counter in turn having a first component configured to cause a first transformation of an upper (e.g., a heel portion of an upper) of the rapid-entry shoe, and a second component configured to cause a second transformation of the upper.

In example embodiments, the first component and the second component are coupled to a common flange portion at a living hinge. In example embodiments, the multi-action counter has a first configuration in which neither the first transformation nor the second transformation is complete. In example embodiments, the multi-action counter has a second configuration in which the first transformation is complete, but the second transformation is not complete. In example embodiments, the multi-action counter has a third configuration in which both the first transformation and the second transformation are complete to facilitate hands-free donning of the rapid-entry shoe.

Another rapid-entry shoe in accordance with example embodiments of the present disclosure comprises a multi-action counter, the multi-action counter in turn having a first component configured to have a first action that causes a first transformation of an upper (e.g., a heel portion of an upper) of the rapid-entry shoe, and a second component configured to have a second action that causes a second transformation of the upper.

In example embodiments, the first component and the second component are coupled to a common flange portion at a living hinge. In example embodiments, the multi-action counter has a first configuration in which neither the first component nor the second component is actuated. In example embodiments, the multi-action counter has a second configuration in which the first component is actuated, but the second component is not actuated. In example embodiments, the multi-action counter has a third configuration in which both the first component and the second component are actuated to facilitate hands-free donning of the rapid-entry shoe.

In accordance with example embodiments of the present disclosure, the first action is different from and independent of the second action, and the first transformation is different from and independent of the second transformation.

In accordance with example embodiments of the present disclosure, the first action comprises a pivot of the first component that results in motion of an upper extremity of the first component that is more rearward than downward (e.g., predominantly rearward) and the second action comprises a collapse of the second component that results in motion of an upper extremity of the second component that is more downward than rearward (e.g., predominantly downward).

Still another rapid-entry shoe in accordance with example embodiments of the present disclosure comprises a multi-action counter, the multi-action counter in turn having a first component configured to pivot rearward, and a second component configured to collapse downward.

In example embodiments, the rearward pivot of the first component expands or opens a topline or throat of the rapid-entry shoe. In example embodiments, in a collapsed configuration, the second component expands an inner dimension of the rapid-entry shoe, and in an uncollapsed configuration, the second component locks or otherwise secures a heel of a user within the rapid-entry shoe. In example embodiments, during donning of the rapid-entry shoe, the rearward pivot of the first component occurs before the downward collapse of the second component.

In accordance with example embodiments of the present disclosure, the first component comprises an arm and a resilient member. In accordance with example embodiments of the present disclosure, the resilient member is one of a distinct band and a portion of an upper of the rapid-entry shoe. In accordance with example embodiments of the present disclosure, the second component comprises a compressible lattice structure.

In accordance with example embodiments of the present disclosure, the first component and the second component are coupled to a common flange portion at a living hinge. In accordance with example embodiments of the present disclosure, the second component is configured to be at least partially nested within the first component during actuation of the multi-action counter.

BRIEF DESCRIPTION OF THE DRAWINGS

The accompanying drawings may provide a further understanding of example embodiments of the present disclosure and are incorporated in, and constitute a part of, this specification. In the accompanying drawings, only one rapid-entry shoe (either a left shoe or a right shoe) may be illustrated, however, it should be understood that in such instances, the illustrated shoe may be mirror-imaged so as to be the other shoe. The use of like reference numerals throughout the accompanying drawings is for convenience only, and should not be construed as implying that any of the illustrated embodiments are equivalent. The accompanying drawings are for purposes of illustration and not of limitation.

DETAILED DESCRIPTION

Figure 1A:
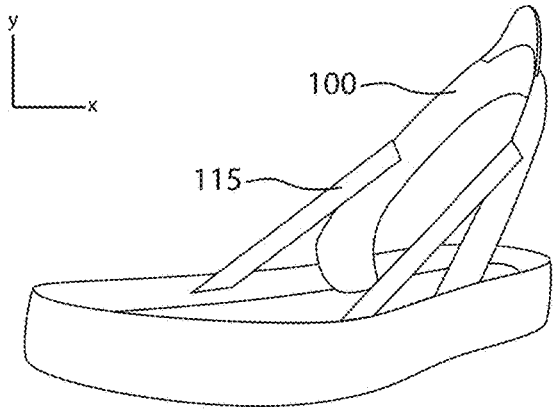
FIGS. 1A and 1B respectively illustrate unpivoted and pivoted arm component configurations of a multi-action counter, in accordance with an example embodiment.

Example embodiments of the present disclosure are described in sufficient detail in this detailed description to enable persons having ordinary skill in the relevant art to practice the present disclosure, however, it should be understood that other embodiments may be realized, and that mechanical and chemical changes may be made without departing from the spirit or scope of the present disclosure. Thus, this detailed description is for purposes of illustration and not of limitation.

For example, unless the context dictates otherwise, example embodiments described herein may be combined with other embodiments described herein. Similarly, references to "example embodiment," "example embodiments" and the like indicate that the embodiment(s) described may comprise a particular feature, structure, or characteristic, but every embodiment may not necessarily comprise the particular feature, structure, or characteristic. Moreover, such references may not necessarily refer to the same embodiment(s). Any reference to singular includes plural embodiments, and any reference to plural includes singular embodiments.

Any reference to coupled, connected, attached or the like may be temporary or permanent, removeable or not, non-integral or integral, partial or full, and may be facilitated by one or more of adhesives, stitches, hook and loop fasteners, buttons, clips, grommets, zippers and other means known in the art or hereinafter developed.

As used herein, the transitional term "comprising", which is synonymous with "including," "containing," or "characterized by," is inclusive or open-ended and does not exclude additional, unrecited elements or method steps. The transitional phrase "consisting of" excludes any element, step, or ingredient not specified in the claim. The transitional phrase "consisting essentially of" limits the scope of a claim to the specified materials or steps "and those that do not materially affect the basic and novel characteristic(s)" of the claimed invention.

No claim limitation is intended to invoke 35 U.S.C. 112(f) or pre-AIA 35 U.S.C. 112, sixth paragraph or the like unless it explicitly uses the term "means" and includes functional language.

In describing example embodiments of the rapid-entry footwear, certain directional terms may be used. By way of example, terms such as "right," "left," "medial," "lateral," "front," "back," "forward," "backward," "rearward," "top," "bottom," "upper," "lower," "up," "down," and the like may be used to describe example embodiments of the rapid-entry footwear. These terms should be given meaning according to the manner in which the rapid-entry footwear is most typically designed for use, with the rapid-entry footwear on a user's foot and with the user's shod foot disposed on or ready for placement on an underlying surface. Thus, these directions may be understood relative to the rapid-entry footwear in such use. Similarly, as the rapid-entry footwear is intended primarily for use as footwear, terms such as "inner," "inward," "outer," "outward," "innermost," "outermost," "inside," "outside," and the like should be understood in reference to the rapid-entry footwear's intended use, such that inner, inward, innermost, inside, and the like signify relatively closer to the user's foot, and outer, outward, outermost, outside, and the like signify relatively farther from the user's foot when the rapid-entry footwear is being used for its intended purpose. Notwithstanding the foregoing, if the foregoing definitional guidance is contradicted by an individual use herein of any of the foregoing terms, the term should be understood and read according to the definition that gives life and meaning to the particular instance of the term.

As used herein, unless the context dictates otherwise, a "rapid-entry shoe" refers to an athleisure shoe, a casual shoe, a formal shoe, a dress shoe, a heel, a sports/athletic shoe (e.g., a tennis shoe, a golf shoe, a bowling shoe, a running shoe, a basketball shoe, a soccer shoe, a ballet shoe, etc.), a walking shoe, a sandal, a boot, or other suitable type of shoe. Additionally, a rapid-entry shoe can be sized and configured to be worn by men, women, or children.

As used herein, unless the context dictates otherwise, a "sole portion" of a rapid-entry shoe refers to an outsole or portions thereof, a midsole or portions thereof, an insole or portions thereof, a wedge or portions thereof, or other suitable structure disposed between and/or adjacent to the foregoing parts of a rapid-entry shoe.

Disclosed herein is a rapid-entry shoe (e.g., a boot or other high top in example embodiments) comprising a multi-action counter. In example embodiments, the multi-action counter provides at least two actions (but can comprise three, four or more actions consistent with those described below).

In example embodiments, and with reference to FIGS. 1A-1F, a first component can be configured to provide a first action and a second component can be configured to provide a second action.

Figure 1B:
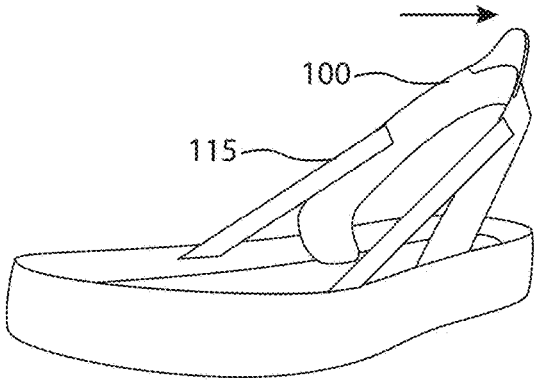

With specific reference to FIGS. 1A and 1B, an action can comprise a rearward pivot of a component 100 (e.g., having a pivoted configuration as in FIG. 1B and an unpivoted configuration as in FIG. 1A, with a return pivot force provided by a resilient member 115). That is, and with reference to the axis shown adjacent to FIG. 1A and the arrow shown adjacent to FIG. 1B, while component 100 may be configured to provide motion in the y direction, component 100 is configured to provide more motion in the x direction (i.e., rearward pivot) than in the y direction in example embodiments. Stated another way, in accordance with example embodiments of the present disclosure, an action comprises a pivot of a component that results in motion of an upper extremity of a component that is more rearward than downward (e.g., predominantly rearward).

Figure 1C:
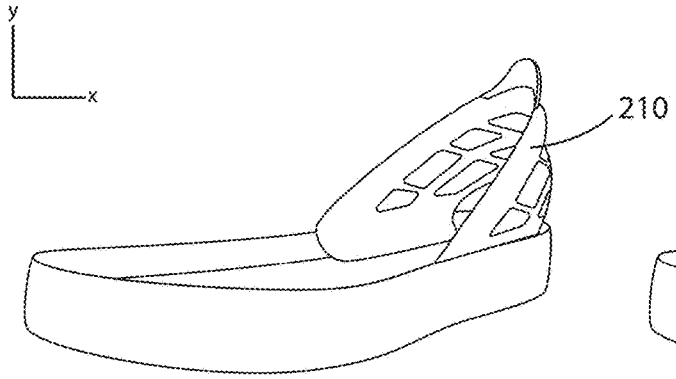
FIGS. 1C and 1D respectively illustrate uncollapsed and collapsed compressible lattice structure component configurations of a multi-action counter, in accordance with an example embodiment.
Figure 1D:
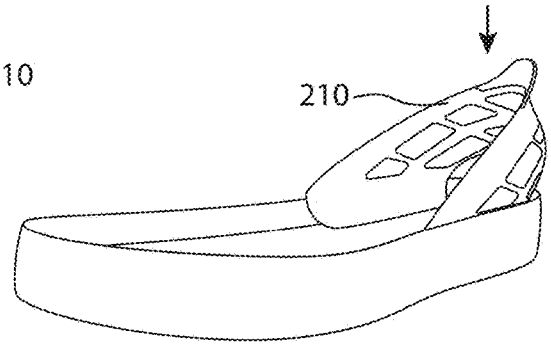

Alternatively, and with specific reference to FIGS. 1C and 1D, an action can comprise a downward collapse of a component 210 (e.g., having a collapsed configuration as in FIG. 1D and an uncollapsed configuration as in FIG. 1C, with a return rebound force provided by a compressible lattice structure). That is, and with reference to the axis shown adjacent to FIG. 1C and the arrow shown adjacent to FIG. 1D, while component 210 may be configured to provide motion in the x direction, component 210 is configured to provide more motion in the y direction (i.e., downward collapse) than in the x direction in example embodiments. Stated another way, in accordance with example embodiments of the present disclosure, an action comprises a collapse of a component that results in motion of an upper extremity of a component that is more downward than rearward (e.g., predominantly downward).

Figure 1E:
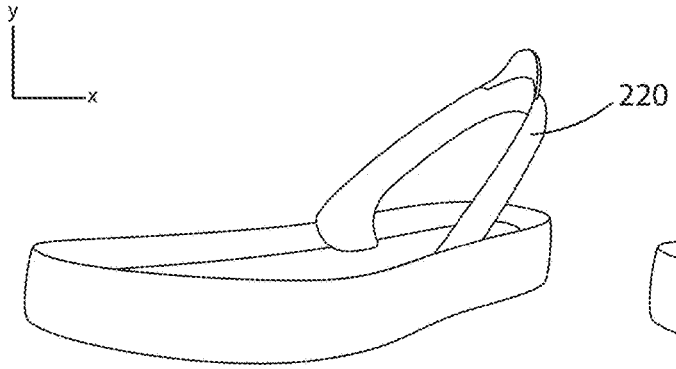
FIGS. 1E and 1F respectively illustrate uncollapsed and collapsed deformable element component configurations of a multi-action counter, in accordance with an example embodiment.
Figure 1F:
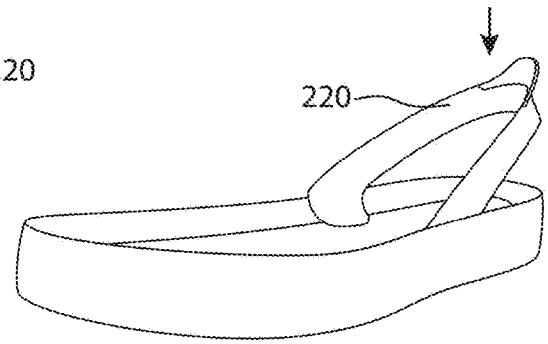

Similarly, and with specific reference to FIGS. 1E and 1F, an action can comprise a downward collapse of a component 220 (e.g., having a collapsed configuration as in FIG. 1F and an uncollapsed configuration as in FIG. 1E, with a return rebound force provided by a deformable element). That is, and with reference to the axis shown adjacent to FIG. 1E and the arrow shown adjacent to FIG. 1F, while component 220 may be configured to provide motion in the x direction, component 220 is configured to provide more motion in the y direction (i.e., downward collapse) than in the x direction in example embodiments. Stated another way, in accordance with example embodiments of the present disclosure, an action comprises a collapse of a component that results in motion of an upper extremity of a component that is more downward than rearward (e.g., predominantly downward).

In example embodiments, a component (i.e., first component, second component, third component, etc.) of the present disclosure is comprised of a material that is resilient or otherwise self-rebounding (e.g., a polymer or foam material). In example embodiments, a component of the present disclosure is not comprised of a textile material.

FIGS. 2A-2C, 3A-3C and 4A-4C now illustrate example combinations of first and second components to provide first and second actions. Of note, in example embodiments, the first and second actions are different. Additionally, in example embodiments, the first and second actions are independent from one another. In other embodiments, the first and second actions are substantially similar.

Figure 2A:
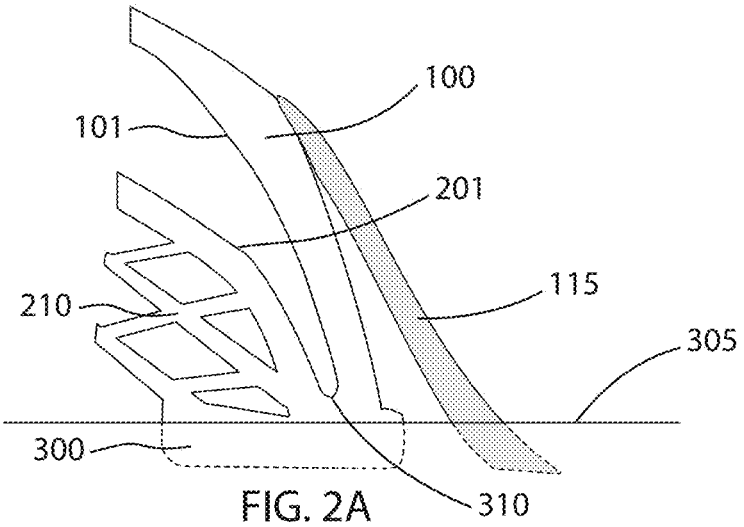
FIGS. 2A-2C illustrate alternate combinations of components of multi-action counters comprising collapsing compressible lattice structures, in accordance with example embodiments.

In an example embodiment, and with reference to FIG. 2A, first action can comprise a rearward pivot of a component 100 (e.g., with return force against the arm that is component 100 provided by a resilient member (coupled between the arm and the sole portion in example embodiments) such as an elastic element 115 (which may be comprised of a distinct band as illustrated or a portion of the upper)). In such an example embodiment, second action can comprise a downward collapse of a component 210 (e.g., with return force provided by the compressible lattice structure that is component 210 that is resilient or otherwise self-rebounding).

Figure 2B:
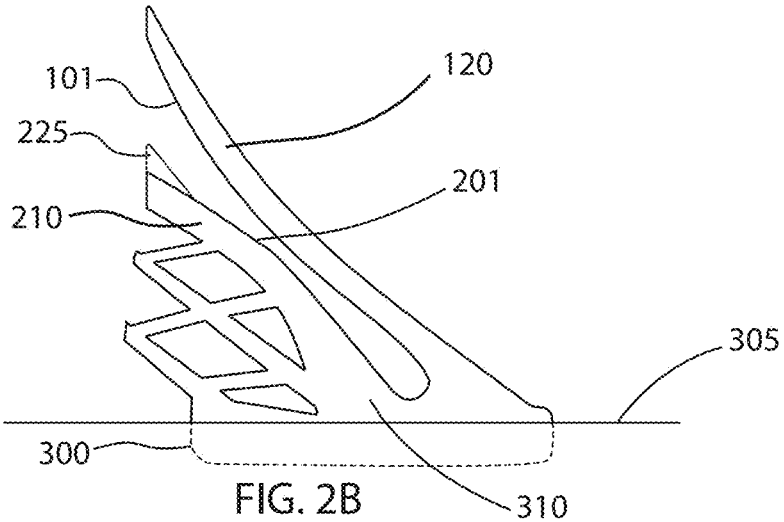
Figure 2C:
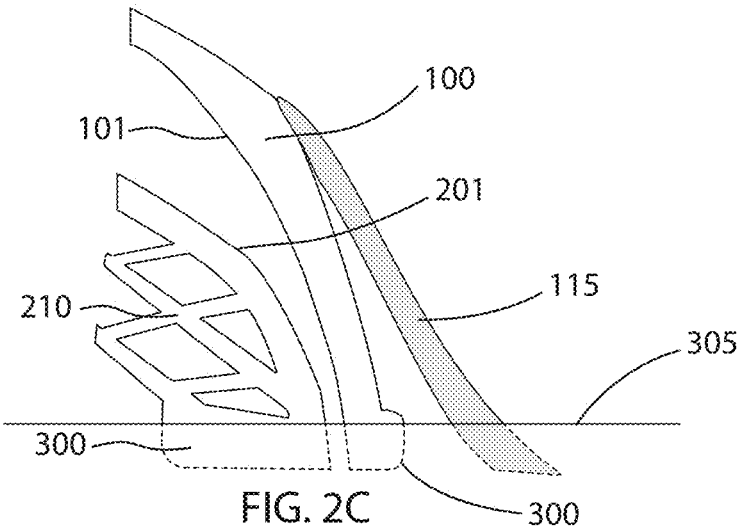

In another example embodiment, and with reference to FIG. 2B, first action can comprise a downward collapse of a component 120 (e.g., with return force provided by the deformable element that is component 120 that is resilient or otherwise self-rebounding). In such an example embodiment, second action can comprise a downward collapse of a component 210 (e.g., with return force provided by the compressible lattice structure that is component 210 that is resilient or otherwise self-rebounding).

The first component 100/120 and the second component 210 can be coupled to a common flange portion 300 (for coupling to the rapid-entry shoe above or as illustrated, below its sole portion 305) at a living hinge 310. In this regard, the living hinge 310 can provide for relative and independent motion between the first component and the second component (e.g., by having a U-shaped or otherwise smooth transition between components). Alternatively, and with reference to FIG. 2C, the first component 110/120 and the second component 210 can be uncoupled (i.e., comprise their own separate respective and distinct flange portions 300).

Figure 3A:
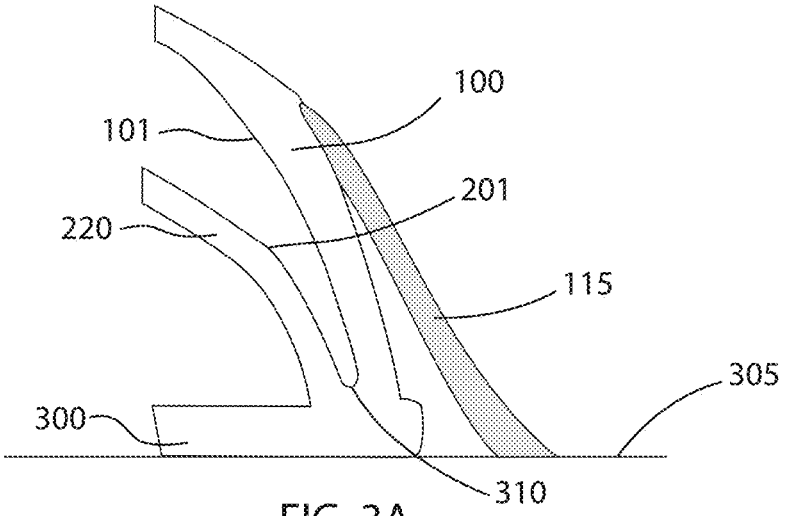
FIGS. 3A-3C illustrate alternate combinations of components of multi-action counters comprising collapsing deformable elements, in accordance with example embodiments.

In another example embodiment, and with reference to FIG. 3A, first action can comprise a rearward pivot of a component 100 (e.g., with return force against the arm that is component 100 provided by a resilient member (coupled between the arm and the sole portion in example embodiments) such as an elastic element 115 (which may be comprised of a distinct band as illustrated or a portion of the upper)). In such an example embodiment, second action can comprise a downward collapse of a component 220 (e.g., with return force provided by the deformable element that is component 220 that is resilient or otherwise self-rebounding).

Figure 3B:
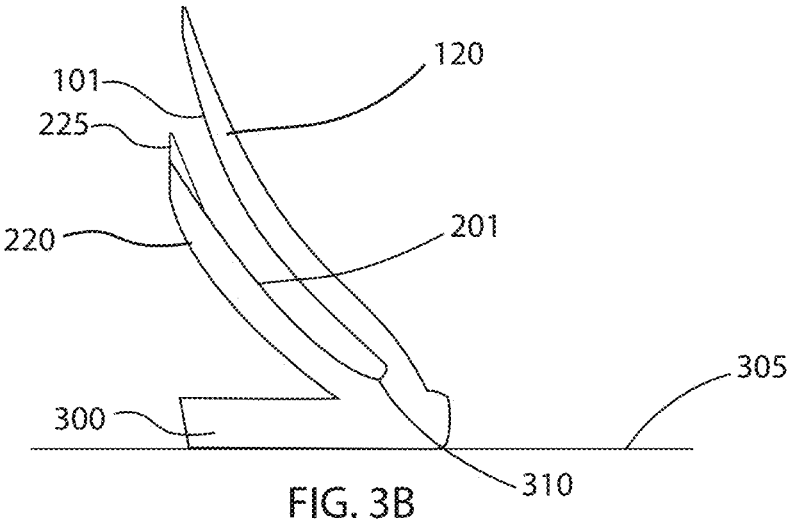
Figure 3C:
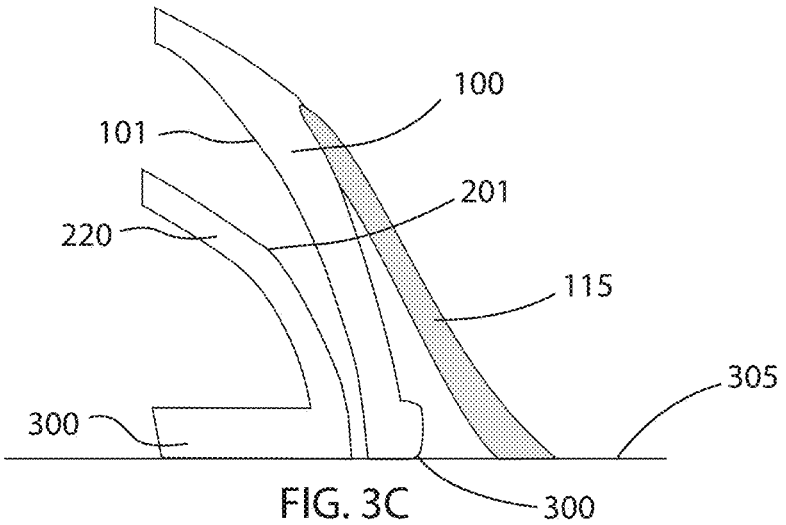

In another example embodiment, and with reference to FIG. 3B, first action can comprise a downward collapse of a component 120 (e.g., with return force provided by the deformable element that is component 120 that is resilient or otherwise self-rebounding). In such an example embodiment, second action can also comprise a downward collapse of a component 220 (but with a different radius of curvature).

The first component 100/120 and the second component 220 can be coupled to a common flange portion 300 (for coupling to the rapid-entry shoe below or as illustrated, above its sole portion 305) at a living hinge 310. In this regard, the living hinge 310 can provide for relative and independent motion between the first component and the second component (e.g., by having a U-shaped or otherwise smooth transition between components). Alternatively, and with reference to FIG. 3C, the first component 100/120 and the second component 220 can be uncoupled (i.e., comprise their own separate and distinct respective flange portions 300).

Figure 4A:
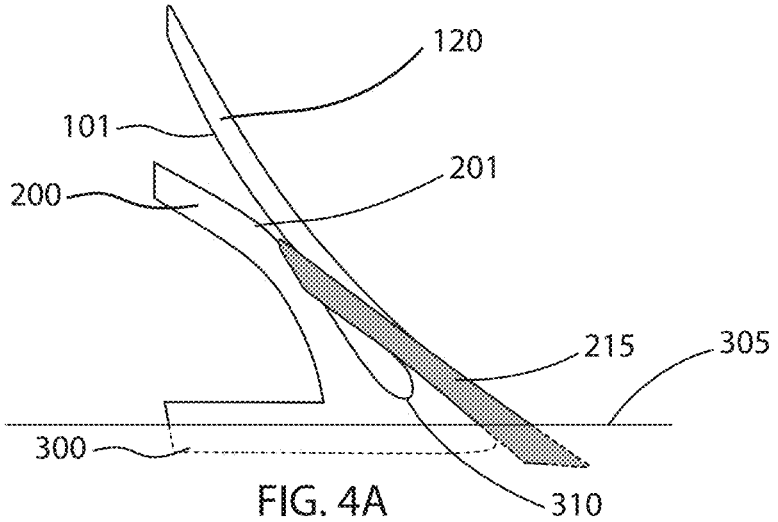
FIGS. 4A-4C illustrate alternate combinations of components of multi-action counters comprising pivoting arms, in accordance with example embodiments.

In another example embodiment, and with reference to FIG. 4A, first action can comprise a downward collapse of a component 120 (e.g., with return force provided by the deformable element that is component 120 that is resilient or otherwise self-rebounding). In such an example embodiment, second action can comprise a rearward pivot of a component 200 (e.g., with return force against the arm that is component 200 provided by a resilient member (coupled between the arm and the sole portion in example embodiments) such as an elastic element 215 (which may be comprised of a distinct band as illustrated or a portion of the upper)).

Figure 4B:
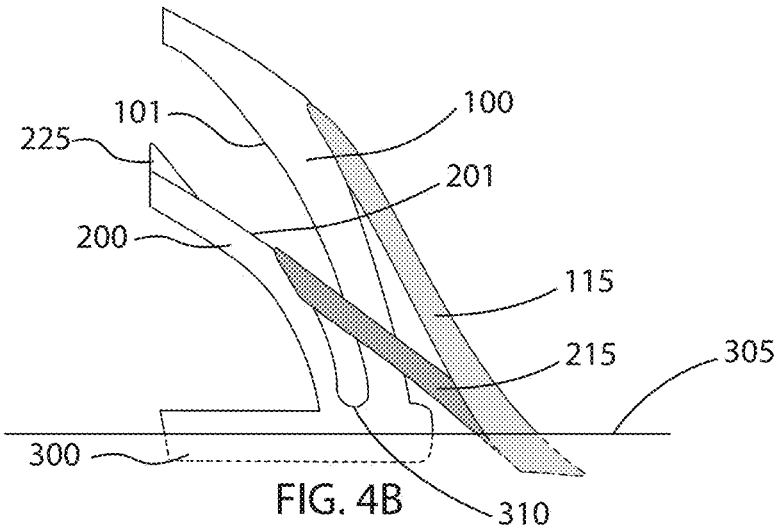
Figure 4C:
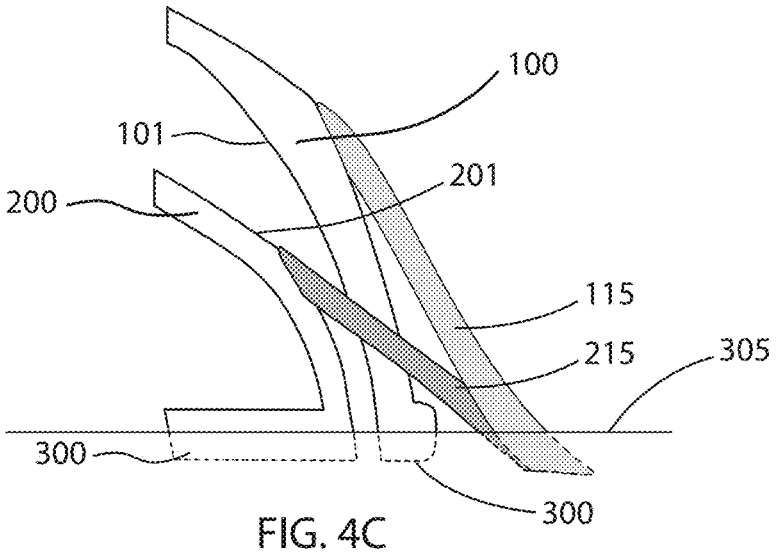

In an example embodiment, and with reference to FIG. 4B, first action can comprise a rearward pivot of a component 100 (e.g., with return force against the arm that is component 100 provided by a resilient member (coupled between the arm and the sole portion in example embodiments) such as an elastic element 115 (which may be comprised of a distinct band as illustrated or a portion of the upper)). In such an example embodiment, second action can also comprise a rearward pivot of a component 200 (but with a different pivot angle).

The first component 100/120 and the second component 200 can be coupled to a common flange portion 300 (for coupling to the rapid-entry shoe above or as illustrated, below its sole portion 305) at a living hinge 310. In this regard, the living hinge 310 can provide for relative and independent motion between the first component and the second component (e.g., by having a U-shaped or otherwise smooth transition between components). Alternatively, and with reference to FIG. 4C, the first component 100/120 and the second component 200 can be uncoupled (i.e., comprise their own separate and distinct respective flange portions 300).

Referring now generally to any of the foregoing example embodiments (i.e., including but not limited to those described with reference to FIGS. 2A-2C, 3A-3C and 4A-4C), the first and second components can be independently coupled to upper (e.g., so as to cause different transformations of an upper, as discussed below). By way of example, a component can be sewn and/or adhered to a layer of an upper.

In example embodiments, the first and second components are separate and distinct from one another. In other example embodiments, the first component (e.g., at its bottom) is coupled to the second component (e.g., at its front). In still other example embodiments, the first and second components are otherwise coupled to a common flange portion at a living hinge, as discussed above. In yet other example embodiments, the first component and the second component together form an unbroken, continuous whole, still comprising a living hinge in example embodiments.

In some example embodiments, and with momentary reference back to FIGS. 2B, 3B and 4B, a component (i.e., a first and/or second component) comprises a stabilizer and/or flare 225 to prevent inward deflection of the component during actuation of the multi-action counter and/or to direct a heel of a user into the rapid-entry shoe.

In example embodiments, the first component extends above and/or forward relative to the second component. In this regard, the first component and the second component can extend from a common flange portion and the first component can have a height measured from the common flange portion greater than that of the second component.

In example embodiments, an edge of the first component is configured to be at least partially nested against (i.e., in contact with, over an extended length) an edge of the second component during actuation of the multi-action counter. In such embodiments, the first component can have a lower dimension 101 that corresponds to an upper dimension 201 of the second component. For example, and with momentary reference to FIG. 3B, both the first component (e.g., along a lower edge 101) and the second component (e.g., along an upper edge 201 that is adjacent to the lower edge 101) can be convex toward the rear of a multi-action counter. Alternatively, and with momentary reference to FIG. 4B, both the first component (e.g., along a lower edge 101) and the second component (e.g., along an upper edge 201 that is adjacent to the lower edge 101) can be concave toward the rear of a multi-action counter. In this regard, the first component can have a perimeter substantially the same as that of the second component (e.g., at an upper perimeter). In some embodiments the first component is nested against a lip or recess formed within the second component.

In example embodiments, the second component is configured to be at least partially nested within the first component during actuation of the multi-action counter. In such embodiments, the first component can pivot at least partially below the top of and around the second component. In this regard, the first component can have a perimeter larger than that of the second component (e.g., at an upper edge of the second component). In some embodiments the first component is nested within a lip or recess formed within the second component.

In example embodiments, a rearward pivot of the first component at least partially contributes to a downward collapse of the second component during actuation of the multi-action counter (e.g., a lower dimension 101 of the first component can pivot at least partially against an upper dimension 201 of the second component). For example, and with momentary reference to FIGS. 2B and 4A, the first component (e.g., along a lower edge 101) can be convex (or uncurved) toward the rear of a multi-action counter and the second component (e.g., along an upper edge 201 that is adjacent to the lower edge 101) can be concave toward the rear of a multi-action counter, such that a vertex (or point) of the lower edge 101 imparts a force on a vertex of the upper edge 201 when the first component is actuated (and thus at least partially contributes to a downward collapse of the second component). In this regard, the first component can have a perimeter substantially the same as that of the second component (e.g., at an upper edge of the second component).

Figure 5A:
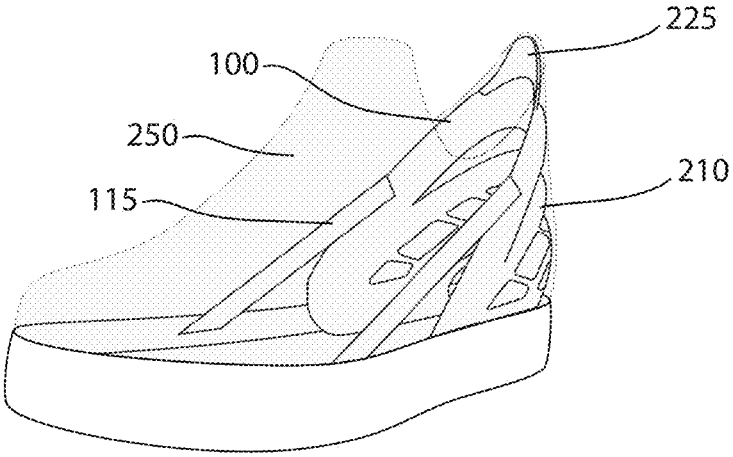
FIGS. 5A-5C illustrate progressive transformations of an upper caused by a multi-action counter in accordance with example embodiments.
Figure 5B:
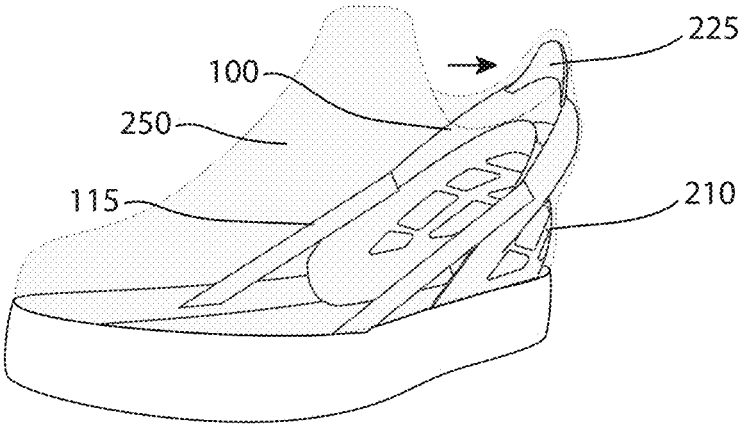
Figure 5C:
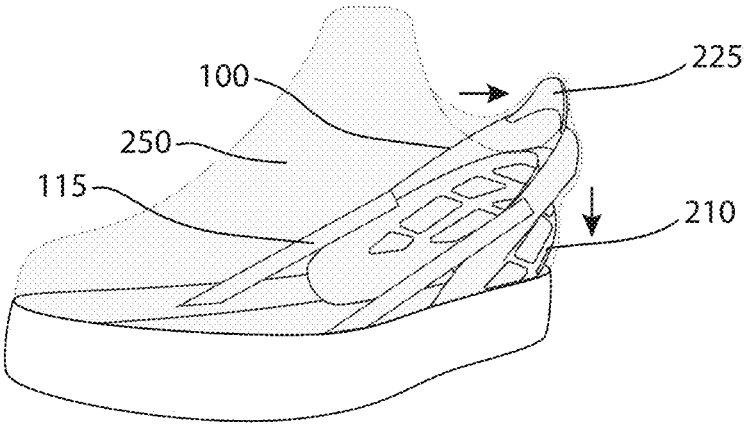

With reference now to FIGS. 5A-5C (as illustrative for each of the example combinations including but not limited to those described with reference to FIGS. 2A-2C, 3A-3C and 4A-4C), in example embodiments, the first and second components of a multi-action counter are actuated sequentially. In example embodiments, during donning, the first component is actuated before the second component. In this regard, a multi-action counter of the present disclosure can have a first configuration (e.g., FIG. 5A) wherein neither the first component nor the second component is actuated, a second configuration (e.g., FIG. 5B) wherein only the first component is actuated predominantly in the direction of the arrow, and a third configuration (e.g., FIG. 5C) wherein both the first component and the second component are actuated predominantly in the direction of the arrows.

In example embodiments, an upper edge of a second component is closer to an upper edge of a first component in a second configuration (e.g., FIG. 5B) than in a first configuration (e.g., FIG. 5A).

In example embodiments, an upper edge of a first component and an upper edge of a second component are both closer to a sole portion of a rapid-entry shoe of the present disclosure in a third configuration (e.g., FIG. 5C) than in a first configuration (e.g., FIG. 5A).

With continued reference to FIGS. 5A-5C (once again, as illustrative for each of the example combinations described above), in example embodiments, transformations of an upper 250 (e.g., a heel portion of an upper 250) caused by the first and second components (and their respective actions) are different and, in some embodiments, also independent from one another.

In example embodiments, a first component (e.g., and a corresponding rearward pivot action) can expand or open a topline or throat of a rapid-entry shoe.

In example embodiments, a second component (e.g., and a corresponding downward collapse action) can expand an inner dimension of a rapid-entry shoe (e.g., when the second component is in its collapsed configuration).

Additionally or alternatively, in example embodiments, a second component (e.g., and a corresponding downward collapse action) can lock or otherwise secure a heel of a user within a rapid-entry shoe (e.g., when the second component is in its uncollapsed configuration). In this regard, a rearmost portion of a second component (e.g., along an upper dimension 201) can be positioned forward relative to the inner surface of a rearmost portion of the upper 250 of the rapid-entry shoe that is adjacent to the second component. In this manner, during hands-free donning of a rapid-entry shoe, a heel passing a second component (e.g., along an upper dimension 201) will be locked or otherwise secured by and beneath the second component.

The second component can also be configured to direct a heel of a user into the rapid-entry shoe (e.g., comprising a flare 225, as discussed above).

In example embodiments, the first and second components (and their respective actions) together cause different transformations of an upper 250 (e.g., a heel portion of an upper 250) to thereby facilitate hands-free donning of a rapid-entry shoe.

It will be apparent to those skilled in the art that various modifications and variations can be made in the present disclosure without departing from the spirit or scope of the disclosure. Thus, it is intended that the embodiments described herein cover the modifications and variations of this disclosure provided they come within the scope of the appended claims and their equivalents.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

We claim:

1. A rapid-entry shoe comprising a multi-action counter, wherein the multi-action counter comprises:

a sole portion;

an upper coupled to the sole portion and defining an inner dimension;

a first component configured to pivot rearward, and a second component configured to collapse downward, wherein the rearward pivot of the first component expands or opens a topline or throat of the rapid-entry shoe, wherein, in a collapsed configuration, the second component expands the inner dimension of the rapid-entry shoe, wherein, in an uncollapsed configuration, the second component is positioned to locks or otherwise secures a heel of a user within the rapid-entry shoe, wherein the first and second components are positioned relative to each other such that, during donning of the rapid-entry shoe, the rearward pivot of the first component occurs before the downward collapse of the second component, wherein a rearwardmost portion of the second component is positioned rearward of a rearwardmost portion of the first component when in an uncollapsed configuration, and wherein the second component is configured to be at least partially nested within the first component during actuation of the multi-action counter.

2. The rapid-entry shoe of claim 1, wherein the first component comprises an arm and a resilient member.

3. The rapid-entry shoe of claim 2, wherein the resilient member is one of a distinct band and a portion of an upper of the rapid-entry shoe.

4. The rapid-entry shoe of claim 2, wherein the second component comprises a deformable element.

5. The rapid-entry shoe of claim 4, wherein the first component and the second component are coupled to a common flange portion at a living hinge.

6. The rapid-entry shoe of claim 5, wherein the first component is nested against a lip or recess formed within the second component.

7. The rapid-entry shoe of claim 1, wherein the first component and the second component are spaced from each other at a rearwardmost portion of the muti-action counter.

8. A rapid-entry shoe comprising a multi-action counter, wherein the multi-action counter comprises:

a first component including a first action configured to cause a first transformation of an upper of the rapid-entry shoe, the first component including an arm and an elastic element coupled to the arm, the elastic element positioned to bias the arm toward a closed position, and a second component including a second action configured to cause a second transformation of the upper the second component being resilient or otherwise self-rebounding to bias the second component toward a closed position, wherein the first component and the second component are coupled to a common flange portion at a living hinge, wherein the multi-action counter includes a first configuration in which the first component of the multi-action counter is in the closed position and the second component of the multi-action counter is in the closed position, wherein the multi-action counter includes a second configuration in which the first component is in an open position and the second component is in the closed position, and wherein the multi-action counter includes a third configuration in which the first component is in the open position and the second component is in an open position to facilitate hands-free donning of the rapid-entry shoe.

9. The rapid-entry shoe of claim 8, wherein the first action of the first component is different from and independent of the second action of the second component, and wherein the first transformation of the first component is different from and independent of the second transformation of the second component.

10. The rapid-entry shoe of claim 9, wherein the first action of the first component comprises a pivot of the first component that results in motion of an upper extremity of the first component that is more rearward than downward and wherein the second action of the second component comprises a collapse of the second component that results in motion of an upper extremity of the second component that is more downward than rearward.

11. The rapid-entry shoe of claim 9, wherein the second component is configured to be at least partially nested within the first component during actuation of the multi-action counter.

12. A rapid-entry shoe comprising a multi-action counter, wherein the multi-action counter comprises:

a sole portion;

an upper coupled to the sole portion;

a first component coupled to the upper and configured to cause a first transformation of the upper of the rapid-entry shoe in which a first portion of the upper is rearranged from a first position to a second position, the first component includes a first elastic element and an arm, the elastic element extending from the arm to a position forward the arm, and a second component coupled to the upper and configured to cause a second transformation of the upper in which a second portion of the upper is rearranged from a first position to a second position, the second component includes a second elastic element extending to the position forward of the arm, wherein the first component and the second component are coupled to a common flange portion at a living hinge, wherein, the multi-action counter has a first configuration in which neither the first transformation nor the second transformation is complete, wherein, the multi-action counter has a second configuration in which the first transformation is complete, but the second transformation is not complete, and wherein, the multi-action counter has a third configuration in which both the first transformation and the second transformation are complete to facilitate hands-free donning of the rapid-entry shoe.

13. The rapid-entry shoe of claim 12, wherein the first portion of the upper includes a topline or throat of the rapid-entry shoe and the first transformation comprises expansion or opening of the topline or throat of the rapid-entry shoe.

14. The rapid-entry shoe of claim 13, wherein the second portion of the upper defines an inner dimension of the rapid-entry shoe and the second transformation comprises expansion of the inner dimension of the rapid-entry shoe.

* * * * *